United States Patent [19]

Brodén et al.

[11] Patent Number: 4,653,731

[45] Date of Patent: Mar. 31, 1987

[54] DEVICE IN CUTTING TORCHES

[75] Inventors: Gert Brodén, Stockholm; Göran Haapanen, Malmö , both of Sweden

[73] Assignee: AGA Aktiebolag, Lidingo, Sweden

[21] Appl. No.: 830,310

[22] Filed: Feb. 14, 1986

[30] Foreign Application Priority Data

Feb. 14, 1985 [SE] Sweden ..... 8500674

[51] Int. Cl.[4] ..... B23K 7/00

[52] U.S. Cl. ..... 266/48

[58] Field of Search ..... 266/48

[56] References Cited

U.S. PATENT DOCUMENTS

| | | | |
|---|---|---|---|
| 3,389,861 | 6/1968 | Nakanishi et al. | 266/48 |
| 3,674,213 | 7/1972 | Mounier | 239/425 |
| 4,455,176 | 6/1984 | Fuhrhop | 266/48 |
| 4,468,007 | 8/1984 | Dillon | 266/48 |

FOREIGN PATENT DOCUMENTS 0097883 6/1983 European Pat. Off. .

*Primary Examiner*—Wayland Stallard

*Attorney, Agent, or Firm*—Pollock, Vande Sande & Priddy

[57] ABSTRACT

A device in a cutting torch which comprises a torch body with a valve housing and a nozzle and with a cutting oxygen duct, a heating oxygen duct and a combustion gas duct disposed in the torch, there being disposed in the torch a connection line which contains a throttling member between the heating oxygen duct and the cutting oxygen duct and wherein disposed in the cutting oxygen duct before the connection line is a valve member which permits a flow of heating oxygen to pass through the cutting oxygen duct only in the direction towards the orifice of the nozzle.

The connection line between the heating oxygen duct and the cutting oxygen duct comprises at least one cooling oxygen duct (7) disposed in the nozzle which is elaborated with three sealing surfaces towards the torch body. The cooling oxygen duct (7) has a diameter which is so adapted in relation to the orifice diameter in the cutting oxygen duct of the nozzle and to the size of the heating flame that during heating of the workpiece a cooling oxygen pressure is rapidly built up in the cooling oxygen duct which prevents hot combustion gases from penetrating into the cutting oxygen ducts and that in the case of short nozzle distances to the workpiece the flow of cooling oxygen is prevented from becoming so great that the surface of the workpiece which is situated below the orifice of the cutting oxygen duct is cooled so rapidly that hole-piercing is rendered more difficult.

5 Claims, 7 Drawing Figures

DEVICE IN CUTTING TORCHES

Figure 1:
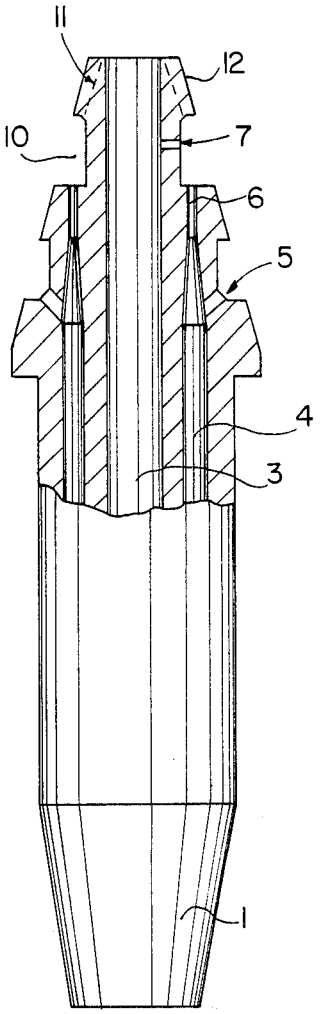

The present invention relates to a device in cutting torches which comprises a torch body with valve housing and nozzle and has disposed in the torch a cutting oxygen duct, a heating oxygen duct and a combustion gas duct, there being disposed in the torch a connection line which contains a throttling means between the heating oxygen duct and the cutting oxygen duct and wherein disposed in the cutting oxygen duct before the connection line is a valve member which permits the flow of heating oxygen to pass through the cutting oxygen duct only in the direction towards the orifice of the nozzle.

In a cutting nozzle, the heat flame is arranged annularly around the cutting duct. The task of the heating flame is to keep the temperature of the workpiece so high that combustion in oxygen can take place and to clean the surface which is to be cut so as to remove rust, protective paint etc. During heating of the workpiece a positive pressure is developed in the empty space inside the flames. This causes the hot gases and the impurities from the plate and the flame to be pressed upwards in the cutting duct with the consequence that the nozzle becomes warm, whereupon particles are able to adhere to the surface of the cutting duct and cause disturbances in the cutting jet when it is switched on, which can result in cutting faults in the cut. These disadvantages can appear both in mechanical cutting torches and in manual cutting torches.

An endeavour to solve these problems has been made with a device which is described in Swedish Pat. No. 7901836-2. This device comprises a connection duct disposed in the torch body of the cutting torch between a heating oxygen duct and a cutting oxygen duct and a check valve member which is provided in the cutting oxygen line before the connection duct. This device can also be disposed in a body between the torch body and valve housing. The purpose is for the transmitted heating oxygen flow which passes out through the cutting oxygen duct during the heating stage of the workpiece to press out the hot gases and thus to cool this duct. This arrangement, however, does have certain disadvantages. One disadvantage is that from the standpoint of production engineering it may be difficult to provide this connection duct in the torch body. Another disadvantage is that the connection duct has a cross-sectional area which is determined once and for all, which means that the flow of heating oxygen which is introduced into the cutting oxygen duct is constant regardless of which nozzle is used in the torch. For certain nozzles, the result of this is that the flow through the cutting oxygen duct is too small, resulting in absence of the desired effect and persistence of the problems. It can also result in other cases in the flow being too large, so that the surface of the workpiece which is situated under the nozzle is cooled so much that a so-called black patch is obtained. This patch causes the hole-piercing which often commences the cutting process to be rendered more difficult.

The object of the present invention is to eliminate these disadvantages. The invention is characterized in this respect largely in that the connection line between the heating oxygen duct and the cutting oxygen duct comprise at least one cooling oxygen duct located in the nozzle, said cooling oxygen duct being designed with three sealing surfaces against the torch body, in that the cooling oxygen duct has a diameter which is adapted in relation to the orifice diameter in the cutting oxygen duct of the nozzle and to the size of the heating flame, in that during heating of the workpiece a cooling oxygen pressure is rapidly built up in the cutting oxygen duct, which prevents hot combustion gases from penetrating into the cutting oxygen duct and in that in the case of short nozzle distances to the workpiece the flow of cooling oxygen is prevented from becoming so large that the surface of the workpiece which is situated under the orifice of the cutting oxygen duct is cooled so much that hole-piercing is rendered more difficult.

The invention is further characterized when the nozzle is designed as a so-called tricone seal or flat-seat seal nozzle in that the cooling oxygen duct comprises at least one hole drilled between the annular recess in the nozzle which constitutes a part of the oxygen gas chamber and the cutting oxygen duct or in that at least one groove is made in the sealing surface which is disposed closest to the centre axis of the nozzle between the heating oxygen chamber and the cutting oxygen duct.

Figure 2:
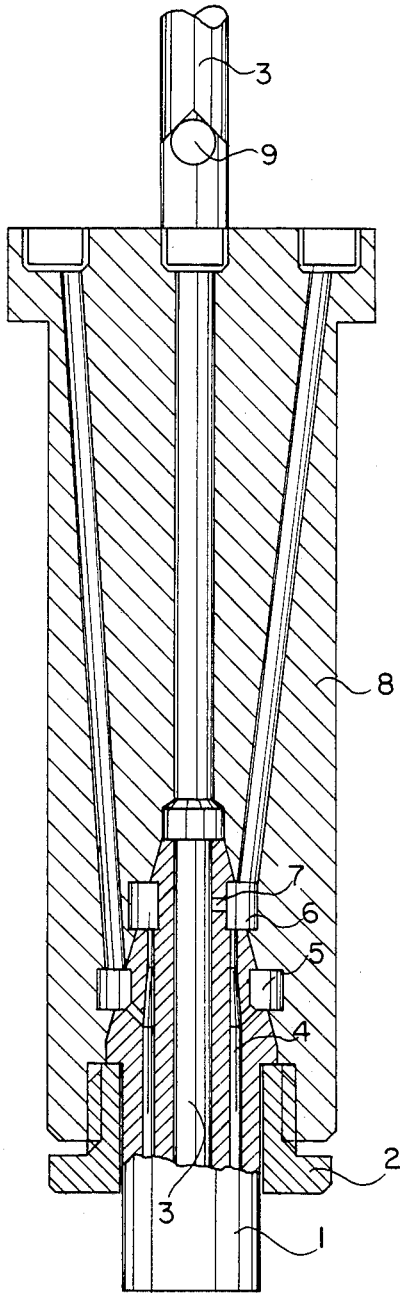
Figure 3:
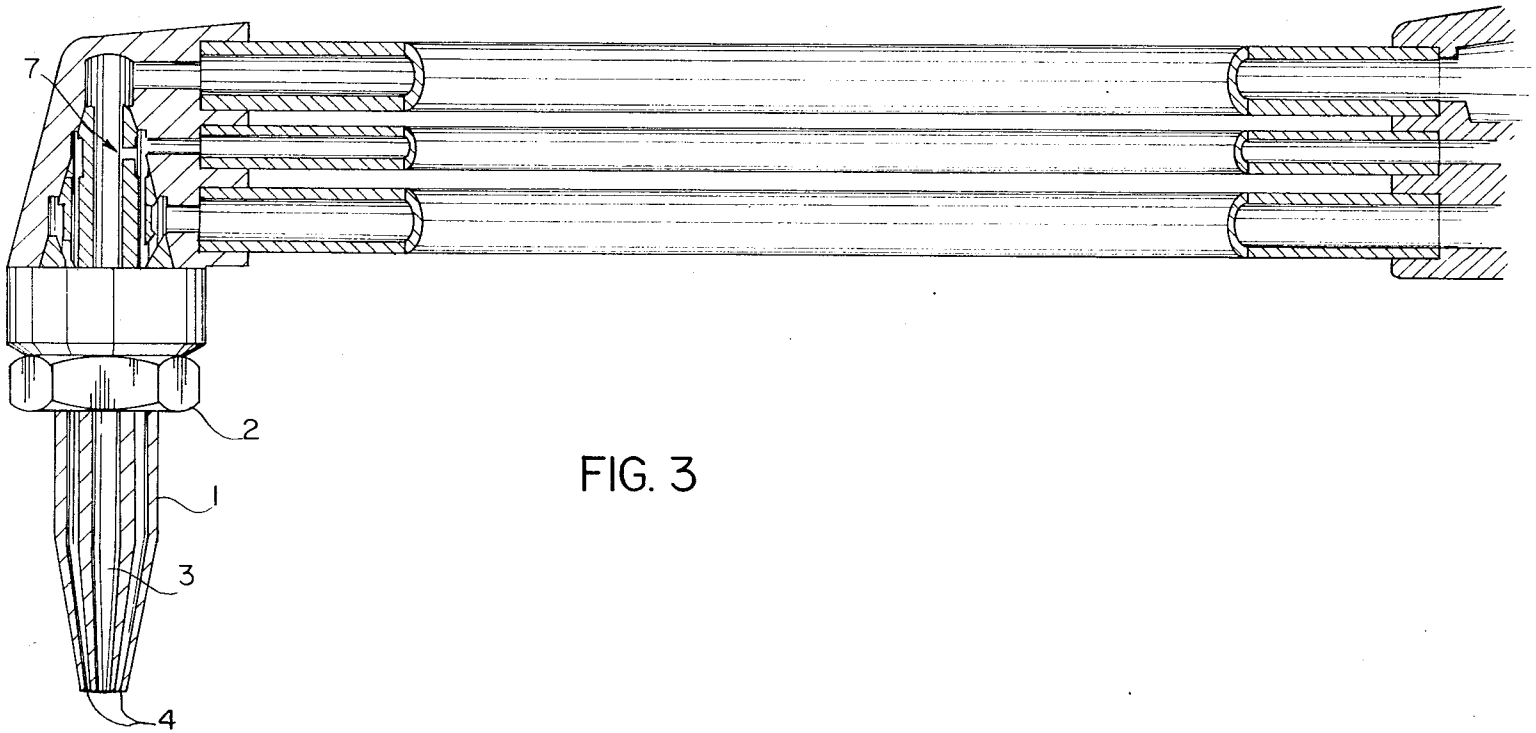
Figure 4:
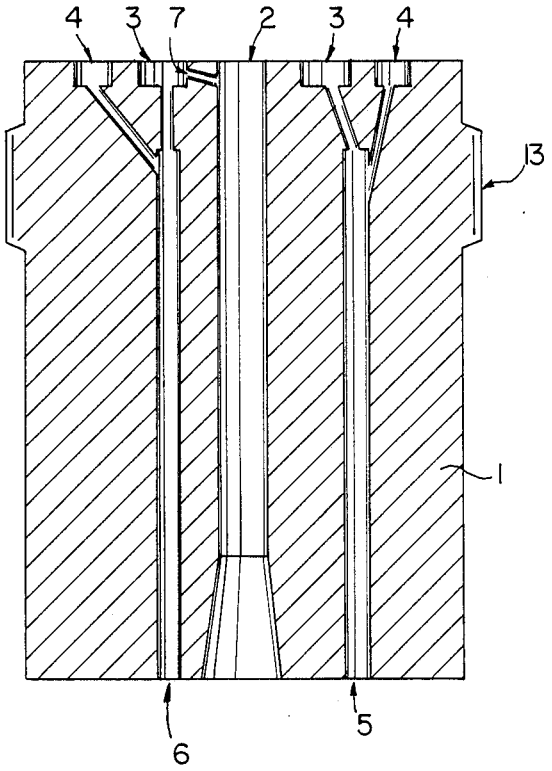
Figure 5:
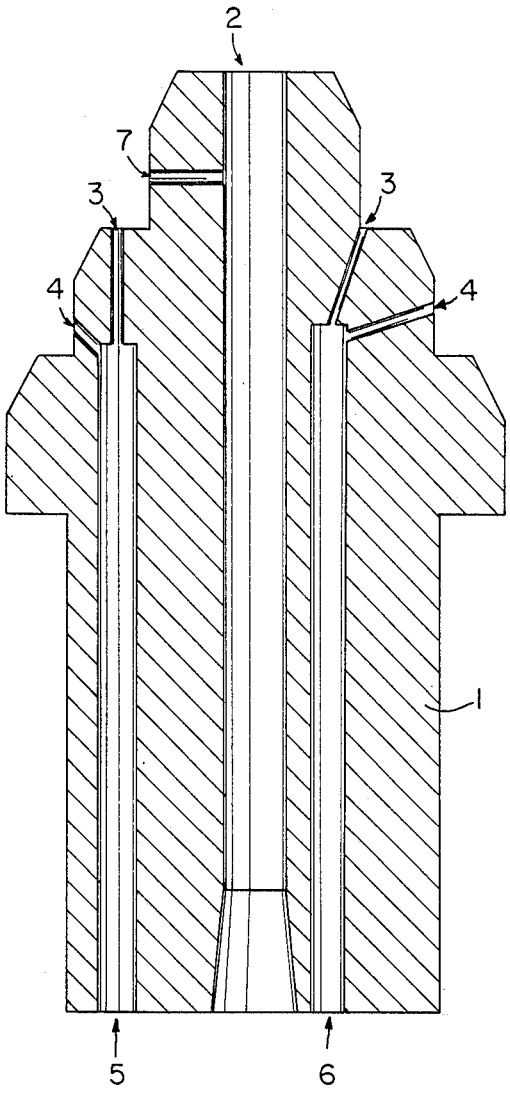
Figure 6A:
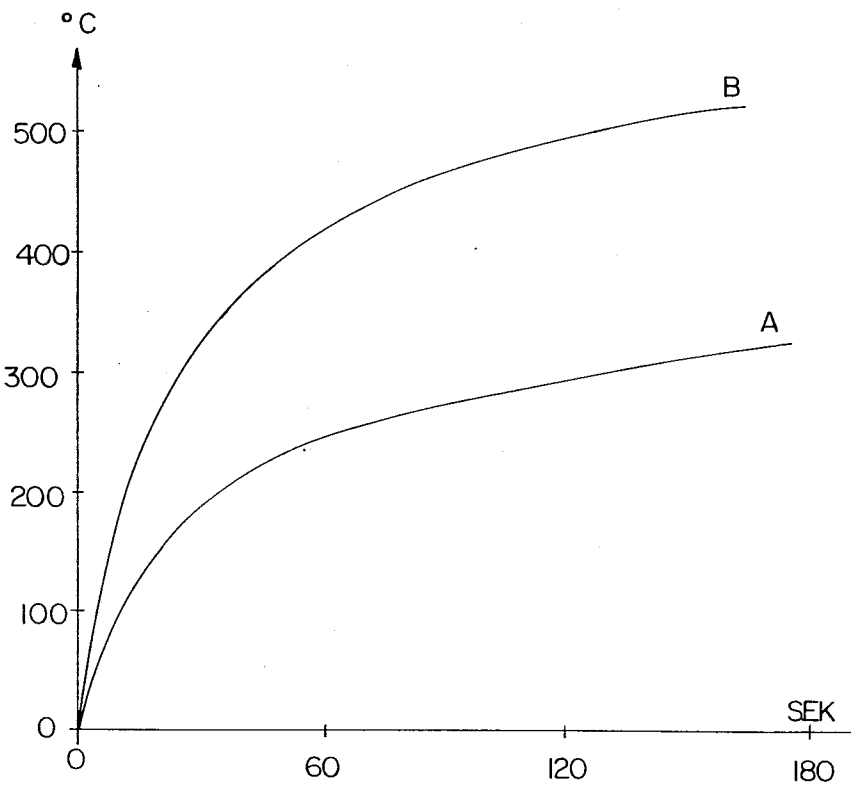
Figure 6B:
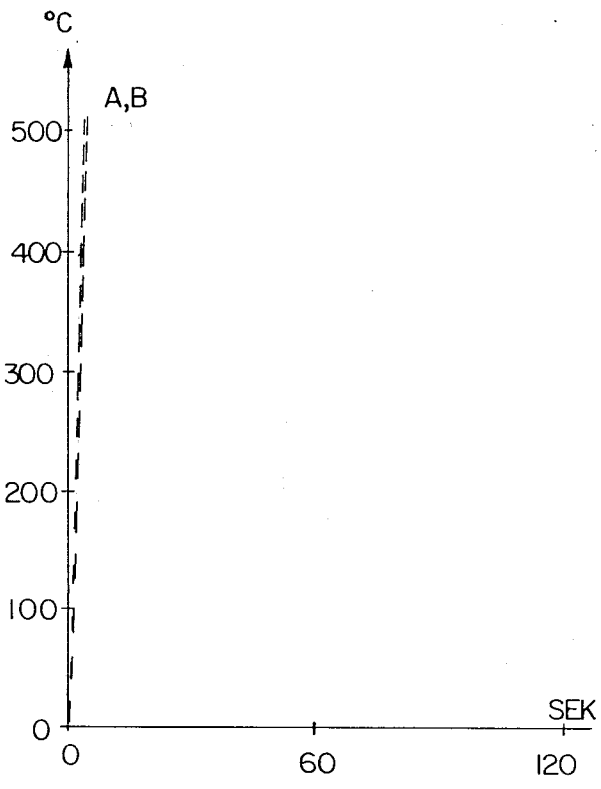

The invention will now be described in greater detail with reference to the accompanying drawings wherein FIG. 1 illustrates a cutting nozzle of so-called tricone seal type, FIG. 2 illustrates such a nozzle applied in a mechanical cutting torch, FIG. 3 shows such a nozzle applied in a hand cutting torch, FIG. 4 shows a cutting nozzle of flat-seat type used for cutting of steel strings, FIG. 5 shows such a cutting nozzle of tricone type FIG. 6*a* shows graphs illustrating the temperature in the orifice of the cutting oxygen duct as a function of the time with a cooling oxygen duct in the nozzle, and FIG. 6*b* shows corresponsing graphs for a nozzle without a cooling oxygen duct.

FIG. 1 illustrates a cutting nozzle 1 made with a so-called tricone seal with corresponding sealing surfaces in the burner body of the cutting torch. Disposed in the nozzle is a cutting oxygen duct 3. Outside this a number of mixed or combustion gas ducts 4 are arranged. Supplied to these latter ducts 4 are both combustion gas via duct 5 and heating oxygen gas via duct 6. Drilled from the annular heating oxygen gas chamber 10 above the duct 6 is one or a plurality of holes 7 to the cutting oxygen gas duct 3. These holes comprise cooling oxygen ducts to the cutting oxygen duct to which part of the heating oxygen flow is thus transmitted. Instead of drilling holes it is also possible to provide grooves 11 in the conical sealing surface 12 which is closest to the centre axis of the nozzle 1. Upon joining of the nozzle to the torch body these grooves will comprise ducts for the cooling oxygen flow.

Shown in FIG. 2 is how the nozzle 1 has been mounted in a torch body 8 with the aid of a nut 2. With the nozzle mounted in a mechanical cutting torch a reverse current trap is required in the form of a check valve 9 which is disposed in the cutting oxygen duct 3 in the cutting oxygen connection of the torch body 8. By this means it is ensured that the flow of heating oxygen transmitted from the heating oxygen duct flows out through the orifice of the cutting oxygen duct. The reference numerals otherwise in this figure are identical with those in FIG. 1.

FIG. 3 illustrates a cutting nozzle of tricone seal type applied in a manual cutting torch. Only the cutting portion in the torch is shown in the figure. The reference numerals in this figure are identical with those in FIG. 1. In a manual cutting torch no counterflow trap is necessary as the manually operated valve in the cutting oxygen duct serves as a check valve member. During the heating stage of the workpiece this valve is kept close as known, whereupon the flow of heating oxygen transmitted through the cooling oxygen duct 7 is forced out through the orifice of the cutting oxygen duct.

The diameter in the cooling oxygen duct can be adapted to the orifice diameter in the cutting oxygen duct, to the size of the heating flame and to the application for which the nozzle is to be used so that an appropriate flow of cooling oxygen is obtained. The cooling oxygen duct is then so elaborated that the flow of cooling oxygen rapidly builds up a cooling oxygen pressure in the cutting oxygen duct which prevents hot combustion gases from penetrating into the cutting oxygen duct. The cooling oxygen flow is also so adapted that it does not render hole-piercing in the workpiece more difficult. If, in fact, the cooling oxygen flow is excessive the surface of the workpiece will be cooled which is located under the orifice of the cutting oxygen flow so much that a so-called black patch is formed which renders the said hole-piercing more difficult. The rate of cooling oxygen flow may lie within the range of 5–150 litres per hour depending on the thickness of the workpiece.

The invention is also applied in nozzles which are used in steelworks with continuous casting and where the cast steel of string is divided by gas cutting into slabs. While being cut, the cast string is red hot and the wear on the nozzles will then be great, despite the gas cutting taking place with a large distance between the nozzle and the string.

An example of a torch nozzle with three sealing surfaces used in continuous casting facilities and in so-called rough cutting is illustrated in FIGS. 4 and 5. FIG. 5 shows a nozzle with a so-called tricone seal and FIG. 4 a nozzle with a so-called flat seat seal. The nozzle according to FIG. 4 comprises a cutting duct 2 and holes for heating flames which can be divided into an outer circle 5 and an inner circle 6. Alternatively, the holes for the heating flames can also be divided up among even more circles. Heating oxygen is supplied between the surfaces to a heating oxygen duct 3 and combustion gas to a combustion gas duct 4. The mixture of combustion gas and heating oxygen for the heating flame can then take place through different ducts inside the nozzle. According to the invention a connection line 7 is drilled between the supply point for heating oxygen, the heating oxygen chamber and the cutting oxygen duct. The invention, moreover, is not restricted in this respect to one hole as a connection line but several holes may be drilled. Instead of drilling these holes it is also possible to make one or a plurality of grooves in the sealing surface closest to the centre axis of the nozzle between the heating oxygen chamber and the cutting oxygen duct. The groove comprises the cooling oxygen duct after the nozzle has been joined together with the torch body. The nozzle may for example be screwed into the torch body by means of threads 13. Upon pre-heating when the cutting oxygen gas flow is turned off, heating oxygen flows via connection line 7 over to the cutting oxygen duct and then out through the nozzle. Flowing upwards through the torch is prevented as previously mentioned by means of a counterflow trap or a shut-off device such as a solenoid valve. This flow presses out hot gases from the cutting oxygen duct in the manner described hereintofore. By this means the nozzle is imparted a longer service life and the operating reliability of cutting is also improved. The flow required to accomplish this is significantly smaller than the cutting oxygen flow used in the actual gas cutting. The flow through the connection line 7 during the pre-heating may lie in the interval of 5–1,000 l/hour.

Described in the form of curves in FIGS. 6*a* and 6*b* are trials in which the temperature in the orifice of the cutting oxygen duct was measured with a thermo-couple during a time period with a duration of 180 seconds. The workpiece has consisted of a cooled copper plate. The nozzle distance was 8 mm. The temperature was measured up to a maximum of 500° C. The trials were performed for a heating oxygen flow of 820 l/h in the first case A and 1,150 l/h in the second case B. The heating oxygen pressure at the torch entrance has been measured as 4.2 bar and 7.4 bar in the respective cases. The pressure has then been throttled in the torch so that the said flow of heating oxygen was obtained. The flow of cooling oxygen was in the first case A 24 l/h and in the second case B 38 l/h. Shown in FIGS. 6*a* and 6*b* are the curves A and B which describe the temperature in the orifice of the cutting oxygen duct as a function of the time from onset of the heating process for the two cases. The unbroken curves represent the conditions with a flow of cooling oxygen in the cutting oxygen duct and the curves drawn with broken lines the conditions without a flow of cooling oxygen. As evident from the unbroken curves which thus relate to a nozzle with a cooling oxygen duct and appreciable time will elapse before a temperature disruptive to the cutting process occurs in the orifice of the cutting oxygen duct. By the time such a temperature has been reached the heating stage will long since have been completed and the cutting stage has commenced.

The device according to the invention described hereintofore is as has already been mentioned intended for gas cutting. Gas cutting is understood in this context to mean not only conventional gas cutting and cutting in continuous casting but also gas-cutting processes such as scrap cutting and gas chiseling.

We claim:

1. A device in a cutting torch which comprises a torch body with valve housing and a nozzle and with a cutting oxygen duct, a heating oxygen duct and a burning gas duct disposed in the burner, there being disposed in the burner a connection line which contains a throttling member between a heating oxygen duct and a cutting oxygen duct and wherein disposed in the cutting oxygen duct before the connection line is a valve member which permits a flow of heating oxygen to pass through the cutting oxygen duct only in the direction towards the orifice of the nozzle characterized in that the connection line between the heating oxygen duct and the cutting oxygen duct comprises at least one cooling oxygen duct disposed in the nozzle which is elaborated with three sealing surfaces towards the torch body, the diameter in the cooling oxygen duct then being so chosen that during heating of the workpiece a cooling oxygen pressure is rapidly built up in the cutting oxygen ducts which prevents hot gases from penetrating into the cutting oxygen duct and wherein the diameter in the cooling oxygen duct during cutting when hole-piercing takes place is so chosen that the flow of cooling oxygen is prevented from becoming so large that the surface of the workpiece which is situated under the orifice of the cutting oxygen duct is cooled so much that hole-piercing is rendered more difficult.

2. A device as claimed in claim 1 wherein the nozzle is elaborated as a so-called tricone seal nozzle or as a so-called flat-seat seal nozzle characterized in that the cooling oxygen duct comprises at least one hole drilled between the annular recess in the nozzle which comprises a part of the heating oxygen gas chamber and the cutting oxygen gas duct.

3. A device as claimed in claim 1 wherein the nozzle is elaborated as a so-called tricone seal nozzle or as a so-called flat-seat nozzle characterized in that at least one groove is made in the sealing surface which is disposed closest to the centre axis of the nozzle between the heating oxygen chamber and the cutting oxygen gas duct.

4. A device as claimed in claims 2 or 3, the nozzle being used for cutting of workpieces in which hole-piercing is desirable characterized in that the flow of oxygen in the cooling oxygen duct lies in the interval of 5–150 1/hour.

5. A device as claimed in claims 2 or 3, the nozzle being used for cutting of slabs from the string of steel obtained in continuous casting and for other rough cutting characterized in that the flow of oxygen in the cooling oxygen duct lies in the interval of 5–1,000 1/hour.

* * * * *